United States Patent [19]

Hertrich

[11] 4,332,582

[45] Jun. 1, 1982

[54] ROTARY FOLDER WITH RESETTABLE RELEASE POINT

[75] Inventor: Klaus Hertrich, Göhrenz, German Democratic Rep.

[73] Assignee: VEB Polygraph Leipzig Kombinat fuer Polygraphische Maschinen und Ausruestungen, Leipzig, German Democratic Rep.

[21] Appl. No.: 36,800

[22] Filed: May 7, 1979

Related U.S. Application Data

[63] Continuation of Ser. No. 861,500, Dec. 16, 1977, abandoned.

[30] Foreign Application Priority Data

Dec. 23, 1976 [DD] German Democratic Rep. ... 196577

[51] Int. Cl.[3] ..... B65H 45/16

[52] U.S. Cl. ..... 493/424; 493/432

[58] Field of Search ..... 270/6-9, 270/60, 49-50, 47, 48, 63-65, 70-77; 493/424-435

[56] References Cited

U.S. PATENT DOCUMENTS

| | | | |
|---|---|---|---|
| 2,711,935 | 6/1955 | Miles | 101/247 |
| 2,941,798 | 6/1960 | Harless | 270/72 |
| 3,865,361 | 2/1975 | Neal | 270/76 |

*Primary Examiner*—Edgar S. Burr
*Assistant Examiner*—A. Heinz
*Attorney, Agent, or Firm*—Michael J. Striker

[57] ABSTRACT

A rotary folder has a folding cylinder provided on its periphery with a plurality of grippers open and closable by radial displacement of respective cam followers. A pack of different release cams is axially displaceable adjacent the cylinder through positions in each of which a respective one of the cams is aligned with the cam followers. Mechanism is provided for pulling the followers radially away from the cams during adjustment, and for rotating the cams themselves for fine adjustment of the closing position in accordance with paper thickness.

3 Claims, 3 Drawing Figures

ROTARY FOLDER WITH RESETTABLE RELEASE POINT

This is a continuation of application Ser. No. 861,500, filed Dec. 16, 1977, now abandoned.

BACKGROUND OF THE INVENTION

The present invention relates to a folding apparatus. More particularly this invention concerns a folding cylinder used in conjunction with a web-fed rotary press.

A rotary press normally prints several pages next to each other on a continuous web which is then subdivided into sheets each having on each side several, typically four, different pages. These sheets are folded, bound, and then trimmed to make a book or magazine.

In a standard rotary folding apparatus there is normally provided a rotatable folding cylinder having on its periphery a plurality of grippers each in a respective axially extending gripper slot. The centers of the sheets are tucked into these slots and the respective grippers are closed. The thus held sheets are then displaced by rotation of the drum to a release point.

It is normally possible to release the sheets at any of a plurality of angularly offset locations. As the grippers are normally operated by respective cam followers that ride on the periphery of a cam fixed relative to the cylinder, it is therefore necessary to change the contour of this cam in order to change the release location. German published specification 2,103,946 shows how this can be done by replacing the cams themselves. Thus to change release points it is necessary to at least partially disassemble the apparatus, entailing a relatively long downtime and a corresponding loss in plant efficiency. It has also been suggested to merely make the cam up of parts that allow its various lobes to be moved angularly about, however this solution also has proven rather cumbersome in use.

It has also been suggested in German Pat. No. 676,745 to use a pair of cams each with the respective cam follower for opening and closing the grippers. Each gripper, therefore, has two respective cam followers and is provided with a clutch that can connect it to either of these followers, depending on the release position. Such an arrangement has, however, shown itself very impractical in practice, and still does not allow for any degree of adjustment of the release position once the respective cam is selected. Furthermore use in a system having more that two release locations is impossible.

SUMMARY OF THE INVENTION

It is therefore an object of the present invention to provide an improved folding apparatus.

Another object of this invention is to provide an improved folding cylinder for use with a web-fed rotary press.

Yet another object is to provide such a folding apparatus wherein a changeover from one release point to another can be effected very easily and simply.

A further object is to provide an improved folding apparatus wherein once the desired release point is selected it is still possible to adjust this location angularly to an at least limited extent.

A further object is to provide such an apparatus wherein the width of the open slot defined by the grippers can easily be adjusted.

These objects are attained according to the present invention in a folding apparatus of the above-described general type wherein a folding cylinder is rotatable on a support about a cylinder axis and carries at least one openable and closable gripper which has a respective cam follower that is radially displaceable for opening and closing of the gripper. According to this invention a plurality of cams is carried on the support at the axis, each cam having a respective periphery that will, if engaged with the follower, cause the respective gripper to open at a respective location. These cams are all fixed axially next to one another without freedom of relative motion in a pack and means is provided for axially displacing the pack through several positions in each of which the cam follower is radially aligned and engageable with a respective one of the peripheries.

According to further features of this invention the pack of cams is joined rigidly together with a ring having a radially outwardly open groove in which engage claws of the hand-operated adjustment mechanism. This groove ring and the cams are keyed to but axially displaceable on a sleeve itself formed with radially outwardly directed teeth that engage a gear that can be rotated to angularly adjust the pack of cams.

This sleeve according to this invention rides on a collar formed on the fixed housing or support and itself formed at its outer end with a cam that in turn serves to close the grippers at the predetermined starting position. Means is provided to lift the cam followers of the grippers from the cams during the adjustment operation when the pack of cams is shifted axially relative to the support.

Thus according to this invention it is possible to change the release point with considerable ease. The cam followers need merely be lifted off of the cam they are riding on, then the entire pack of cams is axially displaced to align another cam with these followers, then the followers are lowered back down. Thereafter it is possible by means of limited angular displacement of the entire pack of cams to make a fine adjustment of the release location. Such an arrangement can easily be set up for many more than two different actuation patterns for the grippers, merely by providing a pack having the necessary number of appropriately contoured cams.

The novel features which are considered as characteristic for the invention are set forth in particular in the appended claims. The invention itself, however, both as to its construction and its method of operation, together with additional objects and advantages thereof, will be best understood from the following description of a specific embodiment when read in connection with the accompanying drawings.

DESCRIPTION OF A PREFERRED EMBODIMENT

Figure 1:
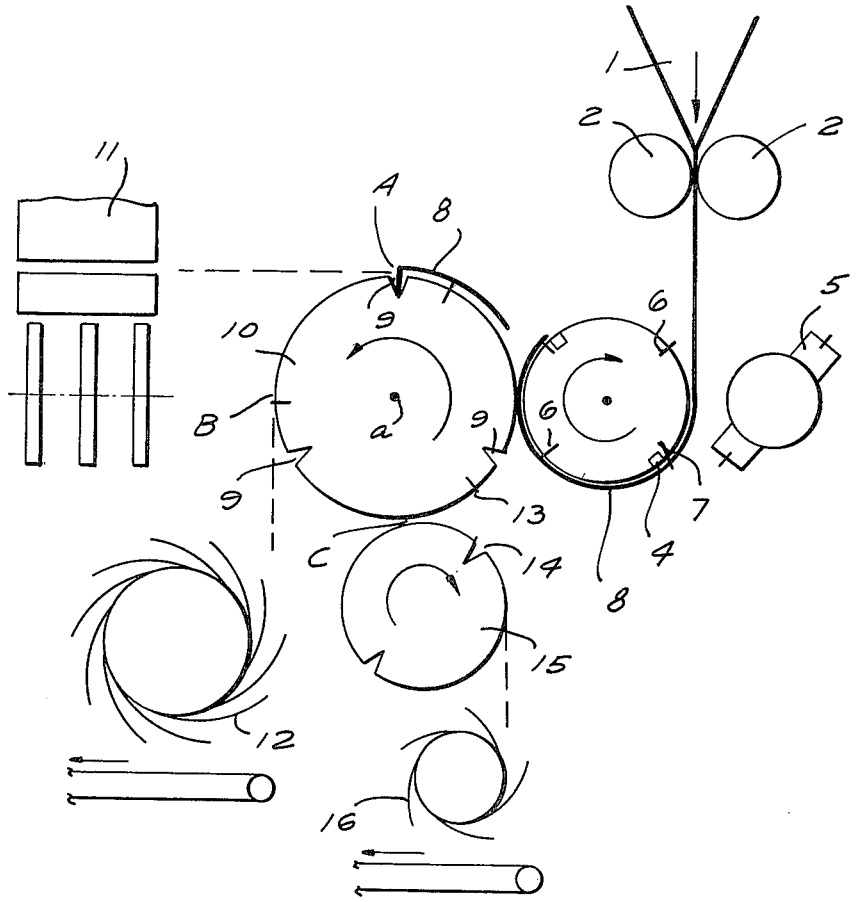
FIG. 1 is a largely schematic view of a folding system using a folding apparatus according to this invention.

As shown schematically in FIG. 1 a web 1 coming from a web-fed rotary press is longitudinally folded and flattened between a pair of guide rollers 2. The web 1, having at one edge a longitudinally extending fold is wrapped around a folding and cutting cylinder 3 having a pair of diametrically oppositely located anvils 4 that coact with the knives of a knife beam 5. Immediately downstream of each of the anvils 4 relative to the direction of rotation of the periphery of the cylinder 3 is a row of pointed pins 7 and angularly equispaced between the anvils 4 on each side of the cylinder 3 is a folding bar 6. Thus the knives of the knife beam 5 will form doubled sheets 8 each extending exactly 180° around the cylinder 3 and each being held at its upstream end by the row of pins 7.

The cylinder 3 is tangent to a folding cylinder 10 having three angularly equispaced folding slots 9 and rotatable about a horizontal axis a. This cylinder 10 is of larger diameter than the cylinder 3, and the distance on the circumference of the cylinder 10 between the slots 9 is exactly equal to half of the circumference of the cylinder 3. The two cylinders 3 and 10 are synchronously rotated at the same peripheral speed in such a manner that the folding bars 6 engage radially into the radially outwardly open fold slots 9. Since these fold bars 6 are located at the centers of the respective sheets 8 this means that these sheets 8 will be folded transversely in half at their centers when the bars 6 engage in the slots 9.

Once thus folded transversely in half the sheets 8 are released by grippers in the slots 9 either at a first station A adjacent a longitudinal folder 11, at a second station B above a separating wheel 12, or at a third station C adjacent another folding cylinder 15. At the station C further folding bars 13 again fold the doubled sheets 8 in half and tuck them into folding slots 14, then the sheets are dropped onto yet another separating wheel 16. The stations A, B and C are spaced angularly apart by unequal distances.

Figure 2:
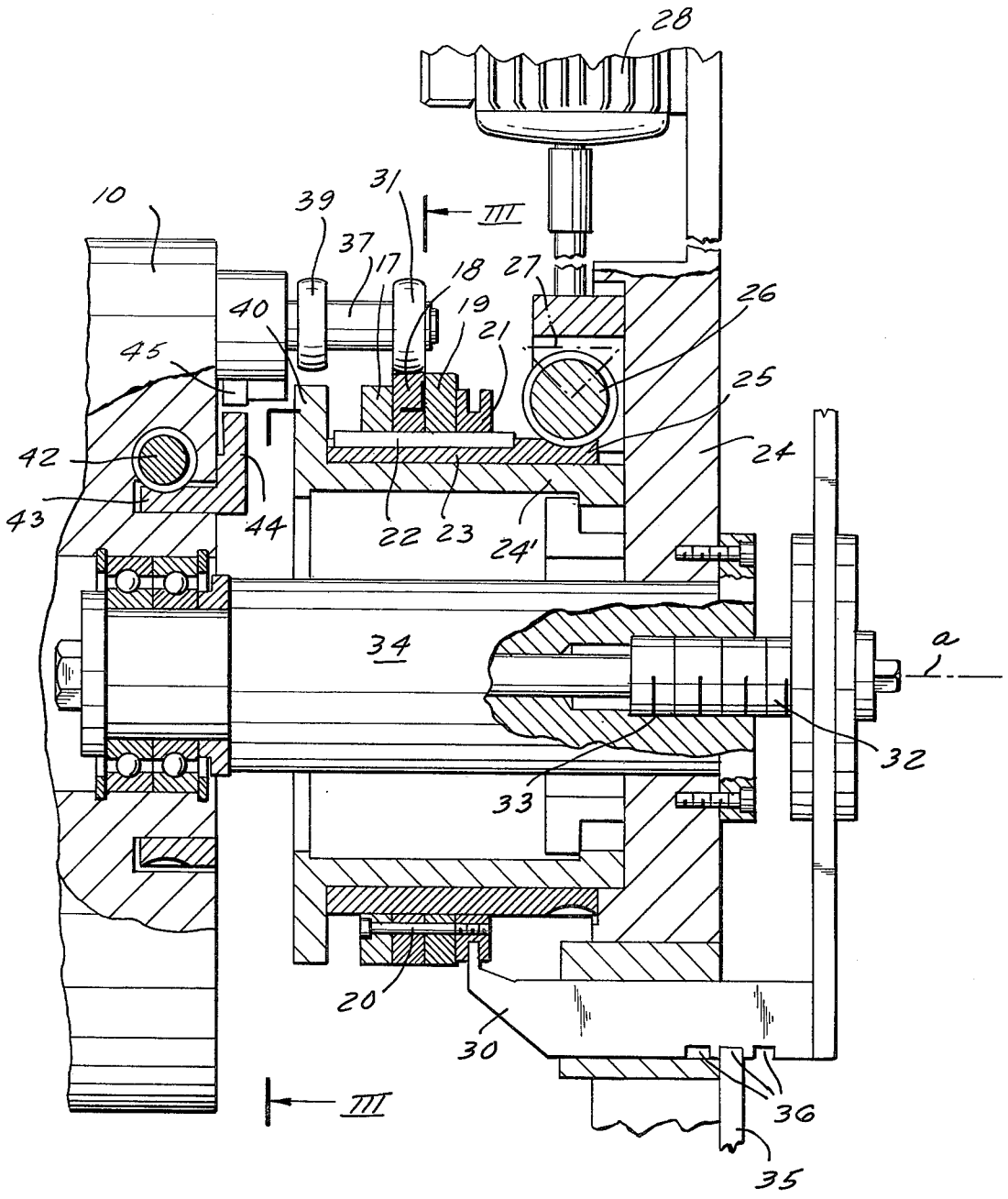
FIG. 2 is a large-scale axial section through the adjustment device for the folding apparatus of this invention.
Figure 3:
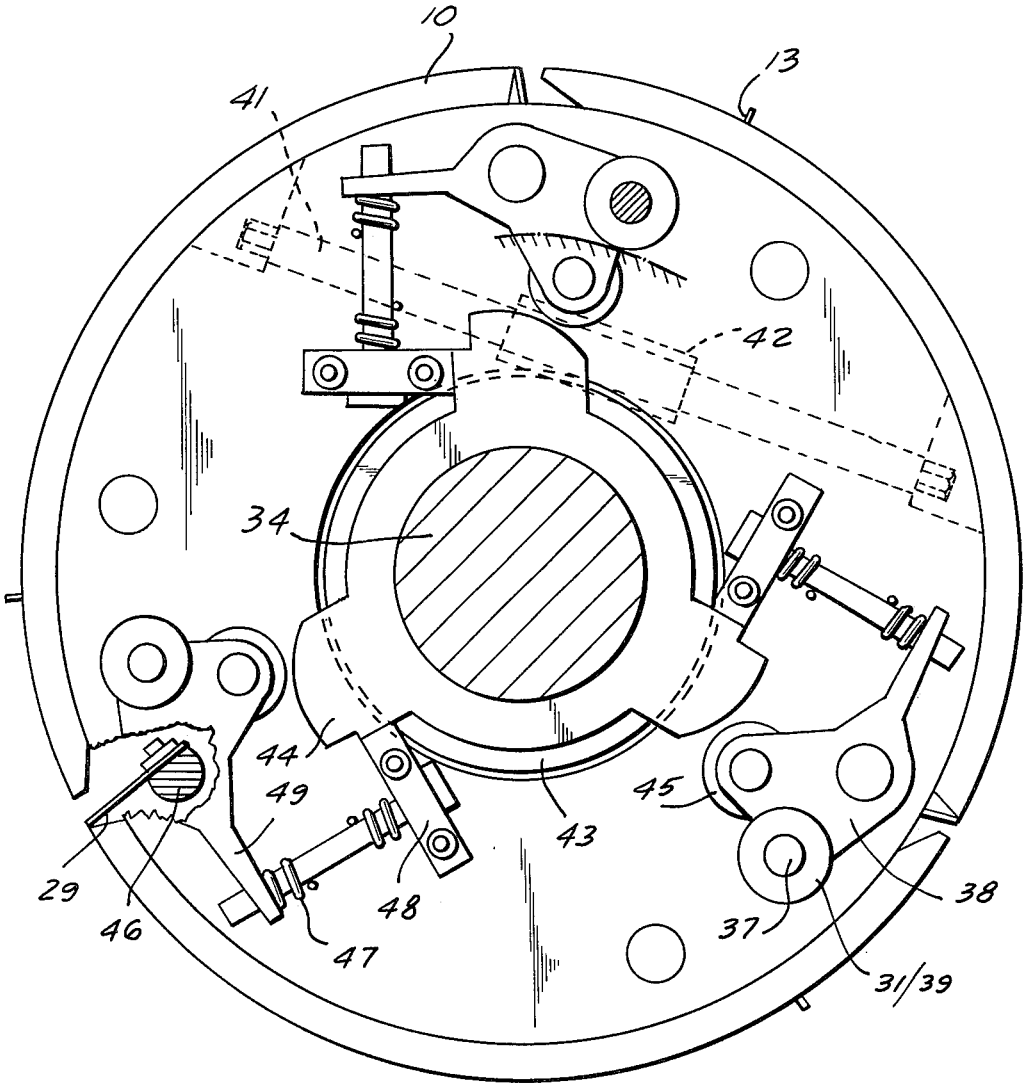
FIG. 3 is a section taken along line III—III of FIG. 2.

As shown in more detail in FIGS. 2 and 3 the apparatus has cams 17, 18 and 19 that respectively control the opening and closing of grippers 29 in the slots 9 at the respective stations A, B and C. These cams 17–19 are locked axially together and to an outwardly grooved ring 21 by means of axially extending screws 20. A key 22 rotationally locks the pack of cams 17–19 to a sleeve 23 but permits relative axial displacement of the pack of cams 17–19 and the sleeve 23.

The sleeve 23 rides on a cylindrical collar 24' bolted to the housing 24 of the apparatus. In addition this sleeve 23 is formed with helical outwardly extending gearing 25 that is in mesh with a worm gear 26 in turn rotatable by means of a bevel gear 27 connected to an electric motor. This bevel gear 27 could also be operated by a handwheel. The use of worm gearing here insures that angular forces applied to the cams 17–19 will not be transmitted back to the element 27 and misadjust the assembly.

Claws 30 engage in the groove of the ring 21 for axial displacement of the cams 17–19 relative to main cam-follower rollers 31. An adjustment screw 32 is threaded into an axial bore 33 in one end of the axle 34 on which the end of the cylinder 10 is journalled. Thus rotating this element 32 to screw it in and out will axially displace the claws 30 and therefore also axially displace the cams 17–19. Notches 36 are formed on one of the claws 30 and are engageable with a locking pawl 35 to lock the cams 17–19 in positions corresponding to riding of the cam-follower roller 31 on respective cams 17, 18 or 19.

Each of the main cam-follower rollers 31 is carried on a shaft 37 projecting axially from a gripper plate 38 pivotal about an axial pin 46 on the cylinder 10. Respective springs 47 each bearing at one side on an abutment 48 on the cylinder 10 and at the other side on an arm 49 of the plate 38 normally urge the grippers 29 into the open position. As the cam-follower rollers 31 ride up and down on the peripheries of the cams 17–19 these grippers 29 are opened and closed.

In addition each of the shafts 37 carries a roller 39 that is engageable with a so-called closing cam 40 formed integrally on the collar 24'. This cam 40 serves to prevent opening of the grippers 29 in any positions except those permitted by the cams 17–19 to minimize wear of these cams 17–19.

The cylinder 10 is provided as best shown in FIG. 3 with three eccentric cam lobes 44 that can coact with auxiliary rollers 45 carried on the plates 38. These lobes 44 are angularly displaceable about the axle 34 by means of a worm 42 meshing with teeth 43 on the lobes 44 and itself carried on a spindle 41 journalled in the cylinder 10 and having hexagonal-section ends operable by means of a conventional wrench.

The device operates in the following manner, taking for example a change in setting from release in position B to release in position A.

First of all the spindle 41 is rotated to bring the lobes 44 into engagement with the rollers 45 and therefore to close all of the grippers 29 and at the same time lift all of the rollers 31 up above the peripheries of the cams 17–19. Thereupon the pawl 35 is pulled out of the middle notch 36 and the screw 32 is rotated counterclockwise to pull the pack of cams 17–19 to the right in FIG. 2 until the cam 17 is aligned radially underneath the followers 31. The pawl 35 is then fitted back into the left-hand notch 36 and the spindle 41 is rotated to lower the follower rollers 31 back down, this time onto the periphery of the cam 17.

Thereafter for a fine adjustment of the position the motor 28 can rotate the cams 17–19 about the axis a.

According to this invention the pawl 35 is normally urged by a spring into engagement in one of the notches 36 and can be only pulled from these notches 36 by means of a solenoid. An end switch carried on the cylinder 10 coacts with the cam lobes 44 and is connected to this solenoid so that only when the cam 44 is in a position corresponding to lifting of the rollers 31 from the cams can this solenoid be actuated to pull the pawl 35 out and allow axial displacement of the cams 17–19.

Thus with the system according to the present invention it is possible in a very easy and rapid manner to change the release location between any of the stations A–C, and thereafter to perform a fine adjustment if desired. At the same time the simplicity of operation by means of a simple cam is retained.

It will be understood that each of the elements described above, or two or more together, may also find a useful application in other types of machines differing from the types described above.

While the invention has been illustrated and described as embodied in a folder for web-fed rotary press, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A folding apparatus comprising:

a fixed support;

a folding cylinder rotatable on said support about a cylinder axis;

at least one openable and closable gripper on said cylinder orbitable about said axis on rotation of said cylinder about said axis;

a cam follower on said cylinder connected to said gripper and radially displaceable to open and close same;

a plurality of cams carried on said support at said axis and each having a respective cam periphery adapted for controlling said cam follower and thus said gripper at a predetermined angular position of said cylinder;

means fixing said cams axially next to one another without freedom of relative motion in a pack;

means for axially displacing said pack through a plurality of positions in each of which a respective one of said peripheries is radially aligned and engageable with said follower; and further comprising means for displacing said follower radially away from and out of engagement with said peripheries during axial displacement of said pack.

2. The apparatus defined in claim 1, wherein said means for displacing said follower includes a cam lobe carried on said cylinder and rotatable relative thereto.

3. The apparatus defined in claim 2, wherein the periphery of said cam lobe is eccentric to said axis and said means for displacing said follower includes a spindle carried on said cylinder, a worm carried on said spindle and operatively engaged with said cam lobe to rotate the latter about said axis.

* * * * *